US007845363B2

(12) United States Patent
Dominey

(10) Patent No.: US 7,845,363 B2
(45) Date of Patent: Dec. 7, 2010

(54) PAINT ROLLER CLEANER

(76) Inventor: Peter John Dominey, 64 The Oaks Parade, Aberfoyle Park, South Australia (AU) 5159

( * ) Notice: Subject to any disclaimer, the term of this patent is extended or adjusted under 35 U.S.C. 154(b) by 1158 days.

(21) Appl. No.: 10/529,158

(22) PCT Filed: Oct. 22, 2003

(86) PCT No.: PCT/AU03/01406

§ 371 (c)(1),
(2), (4) Date: Mar. 24, 2005

(87) PCT Pub. No.: WO2004/037559

PCT Pub. Date: May 6, 2004

(65) Prior Publication Data

US 2006/0016464 A1 Jan. 26, 2006

(30) Foreign Application Priority Data

Oct. 23, 2002 (AU) ..... 2002952214

(51) Int. Cl.
*B08B 3/02* (2006.01)
*B44D 3/00* (2006.01)

(52) U.S. Cl. ..... 134/198; 134/900

(58) Field of Classification Search ..... 134/900, 134/6, 138, 182, 201, 38, 33, 32, 104.2, 137, 134/113, 157, 140, 198; 68/213; 34/58
See application file for complete search history.

(56) References Cited

U.S. PATENT DOCUMENTS 2,301,724 A * 11/1942 Vischer, Jr. ..... 220/203.13
4,126,484 A * 11/1978 Monteiro ..... 134/34
4,711,258 A * 12/1987 Rossborough et al. ..... 134/138
4,765,354 A * 8/1988 Thatcher et al. ..... 134/182
4,778,534 A * 10/1988 Nell ..... 134/32
4,836,702 A 6/1989 Allen (Continued)

FOREIGN PATENT DOCUMENTS

GB 2 311 210 9/1997

(Continued)

OTHER PUBLICATIONS

Hook- definitions from dictionary.com.*

(Continued)

*Primary Examiner*—Michael Kornakov
*Assistant Examiner*—Stephen Ko
(74) *Attorney, Agent, or Firm*—Sand & Sebolt

(57) ABSTRACT

A paint roller cleaner (10) characterized in that it includes a housing (12) adapted to hold a paint roller (24) therein said housing (12) being a close fit around a paint roller (24);

said housing (12) having an opening (16) adapted to receive a paint roller (24) said opening also serving to collect excess paint from the roller (24) for reuse in a first cleaning action; and external locking means (28) for securing said roller (24) in said housing (12) said locking means (28) attaching to a handle (32) of said paint roller whereby said paint roller (24) is restrained from movement relative to the housing (12) by the locking means (28); and whereby cleaning fluid under pressure is introduced into the housing under pressure to thereby effect a second cleaning action on said paint roller (24).

22 Claims, 4 Drawing Sheets

U.S. PATENT DOCUMENTS

| | | | | |
|---|---|---|---|---|
| 4,982,471 | A * | 1/1991 | Bannan | 15/105 |
| 5,086,796 | A * | 2/1992 | Bailey | 134/182 |
| 5,203,372 | A * | 4/1993 | Freiler | 137/469 |
| 5,932,028 | A * | 8/1999 | Carrie et al. | 134/32 |
| 6,019,111 | A | 2/2000 | Gillies | |
| 6,280,531 | B1 | 8/2001 | Galbreath | |
| 6,550,489 | B1 * | 4/2003 | Yates | 134/140 |
| 2002/0166866 | A1 * | 11/2002 | Egan | 220/745 |

FOREIGN PATENT DOCUMENTS

| | | |
|---|---|---|
| GB | 2 318 280 | 4/1998 |
| GB | 2 353 464 | 2/2001 |
| WO | WO 93/24337 | 12/1993 |

OTHER PUBLICATIONS

Defination of Tether; Cambridge Dictionary of American English.*

* cited by examiner

PAINT ROLLER CLEANER

FIELD OF THE INVENTION

The paint roller cleaner of the present invention is used to clean excess paint from a paint roller after use. The cleaner of the invention is directed to both the professional and the domestic markets.

BACKGROUND OF THE INVENTION

Paint rollers are widely used as a practical means of rapidly painting any surface. The roller operated by temporarily absorbing substantial quantities of paint and releasing this under pressure in the rolling action. Depending on the type of paint to be applied, the surface to be painted and the desired finish a paint roller may be formed of a sponge material or a fleecy wool fibre. Other types are rollers are used but perhaps less commonly.

However it can be observed that in most cases once the painter has finished the roller still retains significant quantities of paint in the nap of the roller. This presents several difficulties to the operator. Firstly, paint is expensive and is it undesirable that large quantities should be wasted. There is therefore a need to retrieve as much paint as possible from the roller for later use. Secondly, if paint is allowed to dry on the roller it hardens and renders the roller useless for future use, again a significant cost to the user. There is therefore a need to clean the roller thoroughly for future use.

Cleaning paint from a roller presents its own set of difficulties to the user. Paint typically includes a dispersion of finely divided particles in solvents and pigments. Removing all traces of paint sufficient to avoid clogging the roller as described and also to avoid the risk contaminating any future paint used on the roller has in the past requires very large quantities of water and can be very messy. More importantly the disposal of solvents and paint waste into the domestic waste water system is environmentally undesirable and in some locations prohibited by legislation.

There is therefore a need for paint rollers to be able to be cleaned in a manner that minimises water usage and that confines any water or cleaning fluid for collection and separate disposal Paint roller cleaners are known from the prior art in various forms. The inventor of the present invention has identified a number of difficulties with known prior art forms of cleaners. In some instances large volumes of water are used in the cleaning process thereby creating a problem related to the disposal of the contaminated water. In other prior art systems water is used to clean significant quantities of paint from a roller. This situation leads to both the disposal problems noted above and is, of course also very wasteful of paint.

A further significant difficulty associated with known paint roller cleaning assemblies occurs as a result of the necessity of handling a paint roller charged with paint to be cleaned. In many cases, in order to secure a paint roller in a cleaning apparatus the paint roller has to be separated from its handle, or at least, the operator will need to grasp the roller in a way that makes close contact between the operator and paint charged roller inevitable. The operators hands thus become significantly affected by paint contamination and therefore need cleaning as well.

The present invention addresses itself to the above situation and presents an alternative to prior art paint roller cleaners.

SUMMARY OF THE INVENTION

Therefore, according to a first aspect of the present invention, there is provided a paint roller cleaner including:

a cylindrical housing having an opening adapted to receive a paint roller, said opening having associated therewith an outer flange portion for removing paint from said paint roller, and said cylindrical housing being a very close fit around said paint roller for removing further paint therefrom, said removal of paint constituting a first cleaning action on said paint roller; and external locking means for securing said paint roller in said cylindrical housing, said external locking means attaching to a handle of said paint roller whereby said paint roller is restrained from movement relative to the housing by the locking means, and whereby cleaning fluid is introduced into the housing under pressure to thereby effect a second cleaning action on said paint roller.

The paint roller cleaner of the invention is thereby secured in the cleaner housing by using the locking means to secure the roller handle to the housing. The locking preferably also serves to maintain the position of the roller with respect to the housing. Many prior art cleaner devices rely on the use of a tangential stream of water or cleaning fluid to cause a rotation in the roller which then sheds entrained water through centrifugal action. In the case of the present invention the paint roller is not required to move and the second cleaning action occurs under pressure of fluid in the housing.

In a further form of the invention the position locking means includes a hook member designed to lock around and restrain a handle of a paint roller thereby securing the roller with respect to the cleaner for use. There is thus no requirement to remove the handle from the device to complete the cleaning operation.

In preference, the locking means is preferably located close to the opening of the housing in which the paint roller is received, thereby ensuring that all of the roller is received in the housing.

Preferably, the locking means is a hook is upstanding from an outer surface of the housing and generally in line axially therewith said walls curving around to join one another thereby forming the hook end portion.

Conveniently, the locking means is a snap fit locking means.

Preferably, the flange is positioned perpendicular to the axis of the housing.

More preferably, still an outer edge of the flange has a semi-circular indent serving as a scrapper that may be used to remove excess paint held in a roller before the roller is inserted into the housing.

Preferably, said cleaner further includes a pressure relief means. The pressure relief means may take the form of a plug with a vent opening closed by a plug, said plug being able to be released by pressure within the housing.

The above and other objects, features, and advantages of the present invention will be apparent from the following detailed description of a preferred embodiment in conjunction with the accompanying drawings. In the drawings.

DESCRIPTION OF THE PREFERRED EMBODIMENT

Figure 1:
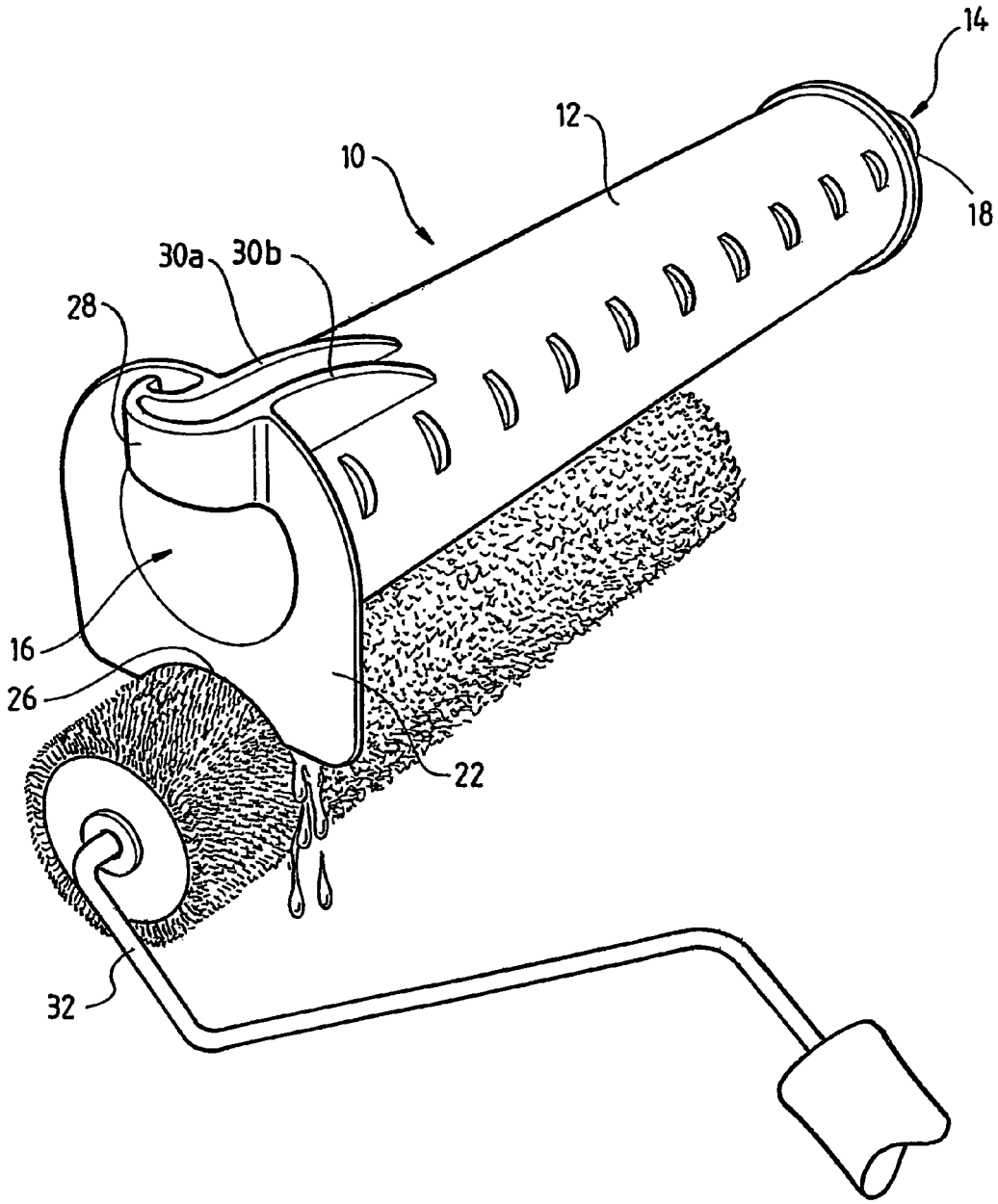
FIG. 1 illustrates in perspective view a paint roller cleaner in accordance with the present invention.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Illustrated in the drawings is a paint roller cleaner 10 formed in accordance with the invention. The paint roller cleaner 10 operates to clean traditional paint rollers as used both domestically and the longer rollers used by professional painters.

The paint roller cleaner 10 includes a generally tubular housing 12 having a first inlet end 14 and a second open, outlet end 16. The open outlet end 16 is open so as to receive a paint roller therein. The inlet end 14 terminates in a narrow spigot 18 that serves as appoint of connection for a source of cleaning fluid such as water. A seal 20 ensures that a fluid tight connection is made even where the fluid is pressurized.

As will be appreciated, the many paints today are water based and hence paint rollers are mainly cleaned in water. However, there is no reason why the device of the invention could not be used with other cleaning fluids. Thus references to cleaning water in the following description can be taken to incorporate other cleaning fluids as appropriate for other paint types. Typically, therefore, the spigot 18 would be attached to a hose or other mains water source. It will also be appreciated that the cleaning devoice of the invention uses substantially less water that prior art cleaning devices and thus it is possible for the inlet 14 to be connected to a small discrete cleaning fluid supply source.

It is convenient if the housing 12 is partially translucent, it is thus possible for the operation of the device to be visible to the operator.

The open outlet end 16 has an outer flange portion 22 around the open end. The flange 22 extends circumferentially around the outlet end 16 and is generally perpendicular to the axis of the housing 12. An outer edge of the flange 22 has a semi-circular indent 26. The indent 26 serves, in use, as a scrapper that may be used to remove excess paint held in a roller before the roller is inserted into the housing 12.

Figure 2:
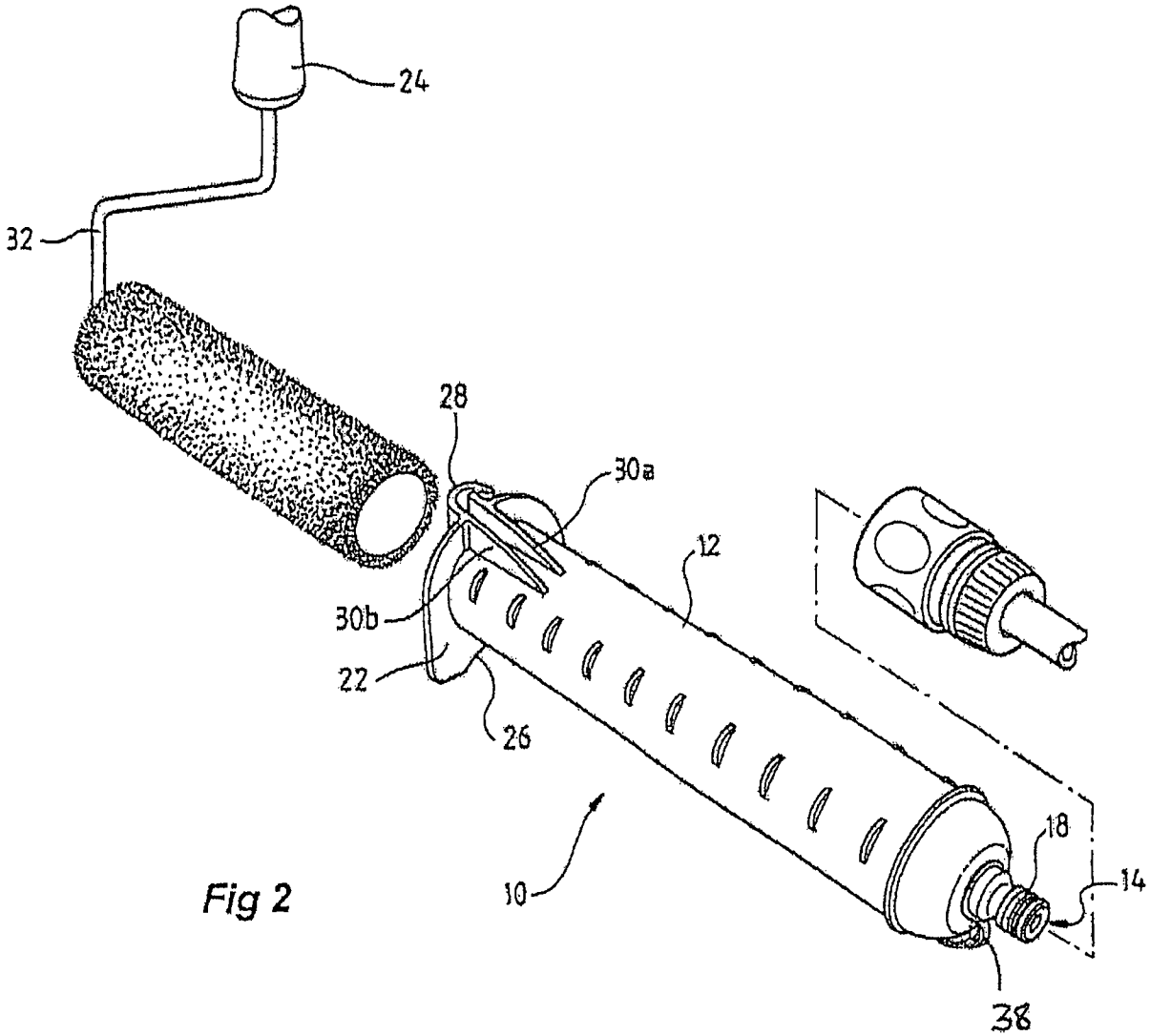
FIG. 2 shows a further view of the paint roller cleaner of FIG. 1.
Figure 3:
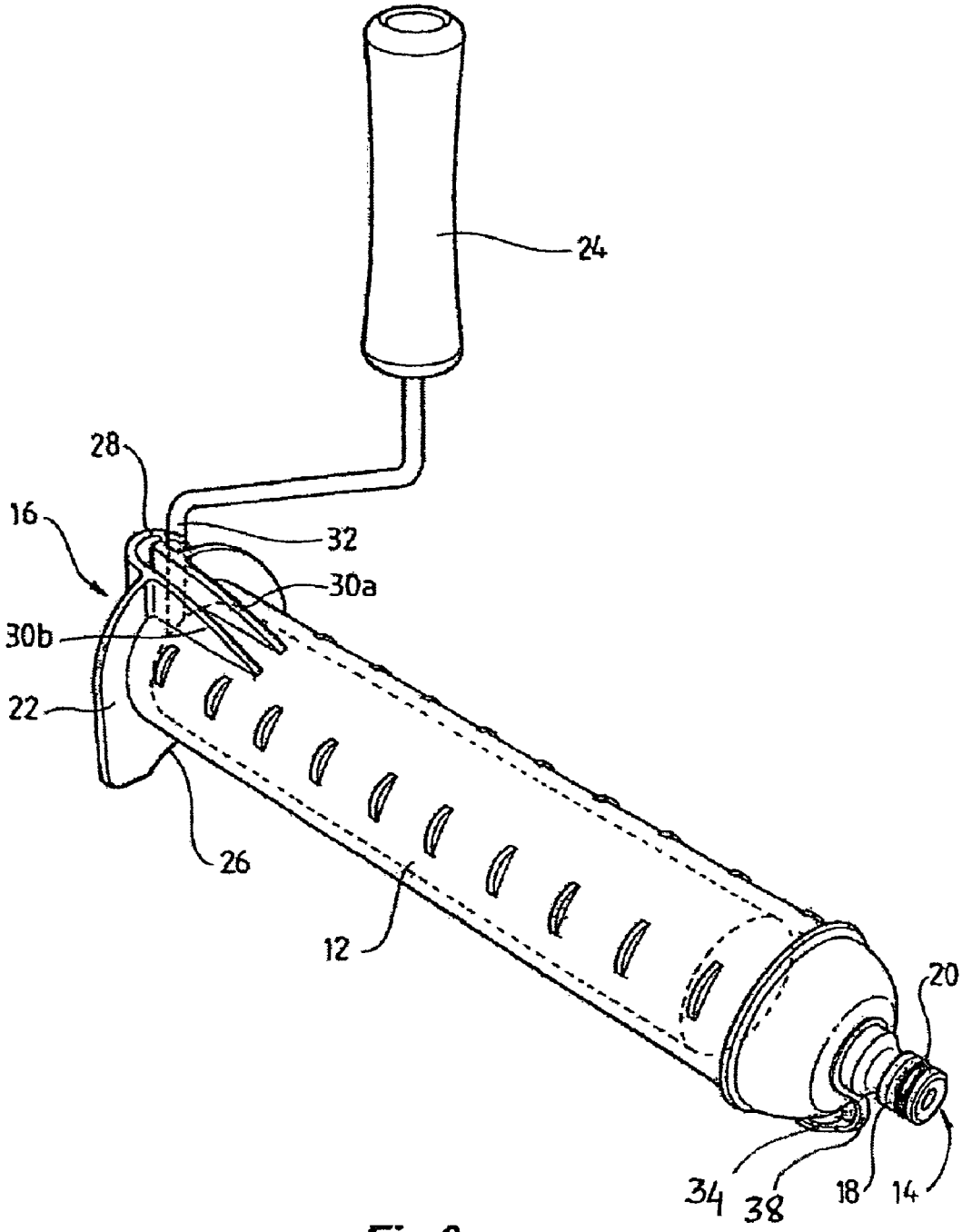
FIG. 3 shows the paint roller cleaner of FIG. 1 with a paint roller inserted therein.

In the drawings it can be seen that the housing 12 is shaped to hold a paint roller 24 therein. The diameter of the housing 12 is very close to that of the paint roller 24. Thus, as the paint roller 24 is inserted in to the housing 12, as shown in FIGS. 1 and 2, any excess paint held on the roller 24 is squeezed off the roller 24.

Thus, in a first cleaning action, paint can be removed from the roller by scraping the roller on the indent 26 of outlet flange 22 and by the act of inserting the roller 24 into the housing 12. Paint collected in this way is easily collected and returned to a tin or other storage device for reuse.

It should be noted that this action occurs simply and without the need for the user to handle the roller 24. Thus, any contact between the user and the roller 24 is minimised, thereby reducing the opportunity for paint to spread onto the body and clothes of the user.

The outlet flange 22 further includes therein a hook 28. The hook 28 is formed by parallel side walls 30*a* and 30*b* upstanding from an outer surface of the housing 12 and generally in line axially therewith. The walls 30*a*, 30*b* pass through the flange 22 and curve around to join one another thereby forming a hook end portion 28. As shown in FIG. 2 the roller support handle 32 is a snap fit under the hook 28.

Thus, as the roller 24 is gradually inserted in the housing 12 the outlet flange 22 and hook 28 encounters the roller handle 32. By rotating the handle 32 it is possible to secure the handle 32 in the hook 28 such that the roller 24 is retained in the housing 12 and is restrained from further movement relative to the housing 12. Importantly, it can be seen that the roller positioning of the roller 24 in the device 10 does not require that the operator comes into contact with the surface of the roller 24 and only the handle 32 of the roller needs to be contacted.

In a second cleaning stage, therefore, a roller 24 is ensconced in the body of the housing 12 and is retained by the hook 28. The close fit between the interior surface of the housing 12 and the roller 24 further assures the position of the roller. Cleaning water is introduced into the device 10 through the inlet spigot 18 and under pressure forces out any paint entrained on the nap of the roller 24.

Figure 4:
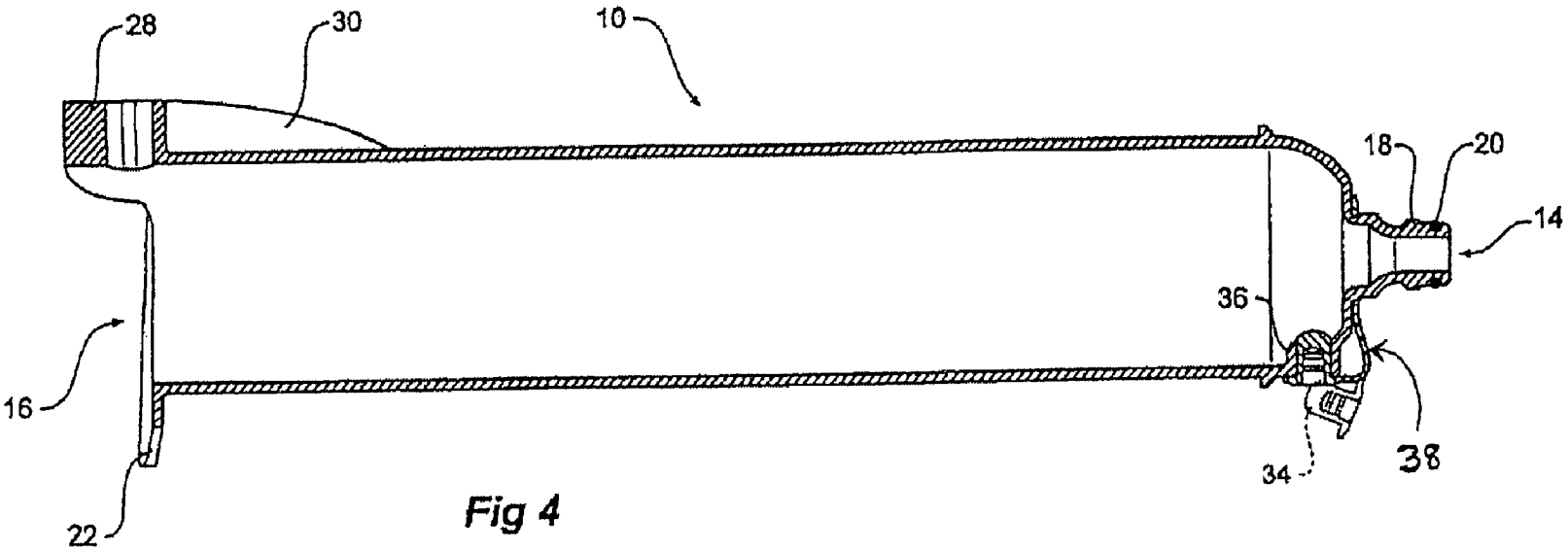
FIG. 4 shows the paint roller cleaner of FIG. 1 in cross sectional view.
Figure 5:
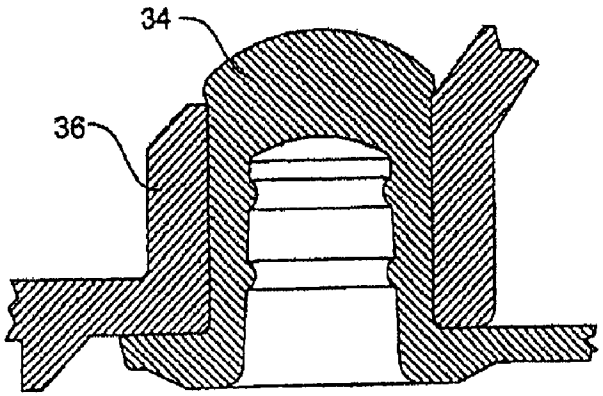
FIG. 5 illustrates a detail of the pressure relief plug.

In the embodiment of the invention under consideration the device 10 is also provided with a pressure relief plug 34, as illustrated in detail in FIGS. 4 and 5. The housing 12 is provided with a vent opening 36 close to the inlet 14. A tether 38 attaches the relief plug 34 to the spigot 18 on the housing 12 and the plug 34 is, under normal conditions, used to close the vent opening 36. To ensure that the plug remains in position it is provided with a slightly oversized end projection that fits over the vent opening 36 securing the plug in position. In the case where a pressure build-up occurs within the housing 12, the plug 34 is pushed out of the vent opening 36 as shown in the dotted detail of FIG. 4.

In use, the device 10 of the invention is used in a first cleaning action to scrape any excess paint off the roller 24 using the indent 26 and by the act of inserting the roller in 24 into the housing 12.

In the second cleaning stage the spigot 18 is attached to a water supply and the water run through the housing under pressure from the roller. It is evident that there is very little free space within the housing 12 when it is occupied by the roller 24. Accordingly, the fluid in the housing 12 is subject to pressure and penetrates the nap of the roller 24 releasing the paint without needing large volumes of the fluid.

To further ensure complete removal of paint from the roller the roller 24 can be released from engagement with the hook 28 and then rotated in the housing 12. The rotation process allows the fibres of the roller to be gently moved to ensure that all entrained paint is removed.

By observing the water emerging from the device it is possible to determine when the paint has been cleaned from the roller.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

The invention claimed is:

1. A paint roller cleaner comprising:

a cylindrical housing having a first end, a second end, and a side wall extending therebetween, wherein said housing has a longitudinal axis extending between the first and second ends and said housing defines a longitudinally aligned bore therein;

an inlet into the bore defined in the first end of the housing an outlet from the bore defined in the second end of the housing, said outlet being adapted to receive a paint roller therethrough, a planar flange extending outwardly away from the second end of the housing and generally perpendicular to the longitudinal axis thereof; said flange extending radially outwardly for a distance beyond the side wall of the housing; where the flange has a first surface facing the first end of the housing, a second surface opposed thereto, and an outermost edge intermediate the first and second surfaces and spaced a distance outwardly away from the side wall of the housing; and a locking member extending generally longitudinally outwardly away from the second surface of the flange and beyond the second end of the housing; and a portion of the locking member is disposed at an angle to the longitudinal axis and is separated from the second surface by a gap, and the gap is adapted to receive part of a handle of the paint roller therein;

a vent opening defined in the side wall of the housing, wherein the vent opening is in fluid communication with the bore;

a reusable plug sized to tightly seal the vent opening against fluid loss from the bore during normal operation of the roller cleaner; and wherein the plug is pushed out of the vent opening only by excessive pressure build-up within the bore.

2. The paint roller cleaner as defined in claim 1, wherein the outermost edge of the flange includes a concave indent complementary in shape to a portion of an exterior circumferential surface of the paint roller and adapted to engage the same.

3. The paint roller cleaner as defined in claim 2, wherein the indent is arcuate in shape.

4. The paint roller cleaner as defined in claim 1, wherein the locking member is substantially arcuate in shape, and the gap between the locking member and the second surface of the flange is substantially arcuate in shape.

5. The paint roller cleaner as defined in claim 4, wherein a portion of the locking member extends inwardly from the first surface of the flange, along the side wall of the housing and toward the first end thereof.

6. The paint roller cleaner as defined in claim 1, wherein the plug has an interior end, an exterior end and sidewall extending therebetween; and wherein the interior end is of a first thickness and the side wall is of a second thickness and the first thickness is greater than the second thickness.

7. The paint roller cleaner as defined in claim 6, wherein the interior end of the plug is of a first diameter and the vent opening is of a second diameter, and the first diameter is greater than the second diameter.

8. The paint roller cleaner as defined in claim 7, wherein the locking member comprises a first and second wall extending outwardly away from the second surface of the flange and spaced a distance apart from each other; wherein the first and second wall taper toward each other and intersect at a tip; and wherein the gap between the locking member and the second surface of the flange is defined between the first wall of the locking member and the second surface of the flange.

9. The paint roller cleaner as defined in claim 8, wherein a portion of each of the first and second walls of the locking member extend inwardly away from the first surface of the flange and toward the first end of the housing; and the portion of the first wall is spaced a distance away from the portion of the second wall; and the distance between the portions of the first and second wall is substantially constant and the portions of the first and second walls are substantially parallel to each other.

10. The paint roller cleaner as defined in claim 6, wherein the plug further includes an annular flange at its exterior end and the annular flange sealingly abuts an exterior surface of the side wall of the housing that circumscribes the vent opening.

11. A paint roller cleaner, comprising:

a cylindrical housing having a first end, a second end, and a side wall extending therebetween, wherein said housing has a longitudinal axis extending between the first and second ends and said housing defines a longitudinally aligned bore therein;

an inlet into the bore defined in the first end of the housing an outlet from the bore defined in the second end of the housing, said outlet being adapted to receive a paint roller therethrough, a planar flange extending outwardly away from the second end of the housing and generally perpendicular to the longitudinal axis thereof; where the flange has a first surface facing the first end of the housing, a second surface opposed thereto, and an outermost edge intermediate the first and second surfaces and spaced a distance outwardly away from the side wall of the housing;

a locking member extending generally longitudinally outwardly away from the second surface of the flange and beyond the second end of the housing; and a portion of the locking member is disposed at an angle to the longitudinal axis and is separated from the second surface by a gap, and the gap is adapted to receive part of a handle of the paint roller therein;

a vent opening defined in the side wall proximate the inlet, wherein the vent opening is in fluid communication with the bore;

a reusable plug sized to tightly seal the vent opening against fluid loss from the bore during normal operation of the roller cleaner; and wherein the plug is pushed out of the vent opening only by excessive pressure build-up within the bore; and a tether connected at a first end to the plug and at a second end to the housing.

12. The paint roller cleaner as defined in claim 11, wherein the first end of the housing narrows to a spigot which defines the inlet therein; and wherein the second end of the tether is received around a circumferential wall of the spigot.

13. The paint roller cleaner as defined in claim 11, wherein the plug has an interior end, an exterior end and sidewall extending therebetween; and wherein the interior end is of a first thickness and the side wall is of a second thickness and the first thickness is greater than the second thickness.

14. The paint roller cleaner as defined in claim 13, wherein the interior end of the plug is of a first diameter and the vent opening is of a second diameter, and the first diameter is greater than the second diameter.

15. The paint roller cleaner as defined in claim 14, wherein the locking member comprises a first and second wall extending outwardly away from the second surface of the flange and spaced a distance apart from each other; wherein the first and second wall taper toward each other and intersect at a tip; and wherein the gap between the locking member and the second surface of the flange is defined between the first wall of the locking member and the second surface of the flange.

16. The paint roller cleaner as defined in claim 15, wherein a portion of each of the first and second walls of the locking member extend inwardly away from the first surface of the flange and toward the first end of the housing; and the portion of the first wall is spaced a distance away from the portion of the second wall; and the distance between the portions of the first and second wall is substantially constant and the portions of the first and second walls are substantially parallel to each other.

17. The paint roller cleaner as defined in claim 13, wherein the plug further includes an annular flange at its exterior end and the annular flange sealingly abuts an exterior surface of the side wall of the housing that circumscribes the vent opening.

18. The paint roller cleaner as defined in claim 11, wherein the outermost edge of the flange includes an indent complementary in shape to a portion of an exterior circumferential surface of the paint roller and adapted to engage the same.

19. The paint roller cleaner as defined in claim 18, wherein the indent is arcuate in shape.

20. The paint roller cleaner as defined in claim 11, wherein the locking member is substantially arcuate in shape, and the gap between the locking member and the second surface of the flange is substantially arcuate in shape.

21. The paint roller cleaner as defined in claim 20, wherein a portion of the locking member extends inwardly from the first surface of the flange, along the side wall of the housing and toward the first end thereof.

22. The paint roller cleaner as defined in claim 11, wherein the first end of the housing narrows to a spigot which defines the inlet therein; and wherein the second end of the tether is received around a circumferential wall of the spigot.

* * * * *